United States Patent [19]

Lemmon

[11] 4,197,598

[45] Apr. 15, 1980

[54] TOILET

[76] Inventor: Newton R. Lemmon, 3030 Fairview Rd., Hollister, Calif. 95023

[21] Appl. No.: 892,602

[22] Filed: Apr. 3, 1978

Related U.S. Application Data

[63] Continuation of Ser. No. 762,607, Jan. 26, 1977, abandoned.

[51] Int. Cl.[2] ..... E03D 3/12; E03D 1/14

[52] U.S. Cl. ..... 4/326; 4/341; 4/415

[58] Field of Search ..... 4/326, 325, 324, 415, 4/341, 342

[56] References Cited

U.S. PATENT DOCUMENTS

| | | | |
|---|---|---|---|
| 3,336,602 | 8/1967 | Kubit | 4/341 |
| 3,894,299 | 7/1975 | Cleary | 4/326 |

*Primary Examiner*—Lenard A. Footland

*Attorney, Agent, or Firm*—John L. McGannon

[57] ABSTRACT

A siphoning water closet incorporating a toilet bowl having a first flushable reservoir for liquid wastes and a second flushable reservoir for solid wastes, the reservoirs being separately flushable so as to expend less flushing water and to expel less disposable sewage than conventional single flush siphoning water closets.

4 Claims, 3 Drawing Figures

TOILET

This is a continuation of application Ser. No. 762,607 filed Jan. 26,1977, now abandoned.

BACKGROUND OF THE INVENTION

This invention relates to water closets and particularly to a water economizing siphoning water closet.

Conventional tank-type and valve-type water closets expend five to eight gallons of flush water at each use in order to assure that the toilet bowl is thoroughly evacuated of waste materials, both solid and liquid. However, it can be appreciated that liquid waste requires substantially less flush water than do solid wastes. With the current consciousness of the relative scarcity of resources, including water, and with the continued desire to maintain a high level of cleanliness in sanitary facilities, it is apparent that a need exists for an improved water closed capable of conserving water while assuring sanitary disposal of human wastes. In addition, the need exists to reduce the amount of sewage generated by municipalities.

SUMMARY OF THE INVENTION

To the end of conserving water while maintaining adequate sanitation in waste disposal, a water closet is provided comprising a toilet bowl incorporating a main flushable reservoir and an additional, relatively smaller, flushable reservoir or urinal adjacent and forward of the main reservoir. The two reservoirs employ separate flushing systems with independent water supply means. Independent siphon-type trap systems are employed for evacuating the reservoirs. A depressed rim transverse of the toilet bowl separates the two reservoirs. In a particular embodiment, namely, in the tank-type water closet typically used in residential applications, a water supply means is utilized which provides separate flushing but is contained within a conventional tank. The flushing system for the smaller reservoir is defined by a container in the tank which is filled through the holes in the container by water from the tank itself. The amount of flushing water can be determined by the height and size of the container and the size of the holes.

An object of this invention is to conserve supply water expended during the disposal of human wastes. The disposal of liquid water typically occurs three to five times as often as the disposal of solid waste. A particular advantage of the present invention is that considerably less water is utilized in the disposal of liquid wastes.

A further object of this invention is to reduce the volume of disposal sewerage through the reduction of the normal supply water requirement.

A still further object of the invention is to provide a flushable toilet bowl with reduced volume flushing.

BRIEF DESCRIPTION OF THE DRAWINGS

The invention may be better understood by reference to the following detailed description of the preferred embodiments in conjunction with the accompanying drawings in which.

DETAILED DESCRIPTION OF THE PREFERRED EMBODIMENTS

The present invention is illustrated with the particular reference to tank-type flushing systems as typically employed in residential applications. However, it should be understood that many aspects of the invention are also applicable to the valve-type flushing systems such as often employed in non-residential applications.

Figure 1:
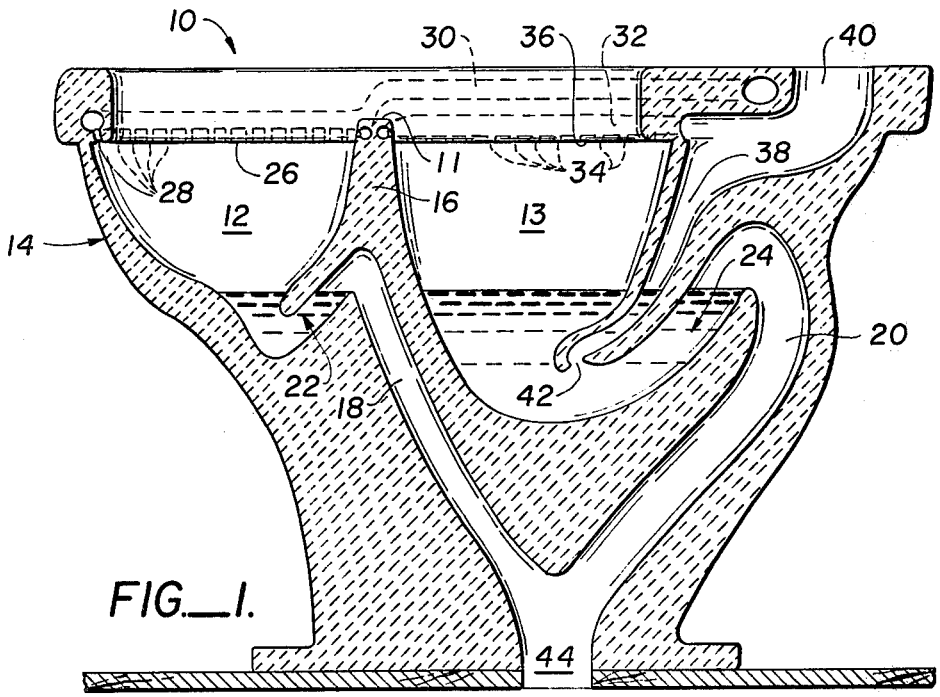
FIG. 1 is a side view in cutaway of a water closet according to the invention.

Referring particularly to FIG. 1, there is illustrated a water closet 10 with a forward reservoir 12 for collecting liquid water such as urine and an aft reservoir 13 for collecting solids. The two reservoirs 12 and 13 comprise the flushable portion of a toilet bowl 14. The forward compartment or reservoir 12 and the rear compartment or reservoir 13 are separated by a recessed rim 16 transverse of the toilet bowl 14. Each reservoir 12 and 13 is provided with respective siphoning throats 18 and 20. The ambient water level is established in the forward reservoir 12 by a first trap 22, and in the aft reservoir a second trap 24.

First and second siphoning throats 18 and 20 leading from the traps 18 and 20 merge at the base of the water closet 10 where waste is discharged through an outlet 44 into the sewer system.

Flushing water is supplied to the forward reservoir 12 by an inwardly disposed first flushing rim 26 around the forward reservoir 12. Orifices 28 serve to introduce flushing water into the forward reservoir 12 from a conduit 30 leading from a flushing water supply (not shown in FIG. 1). Similarly, a water conduit 32 serves to supply rim flushing through orifices 34 of a second flushing rim 36 around aft reservoir 13. In addition, a conduit 38 which shares a common supply 40 with conduit 32 provides flush water at the normally submersed level of the second compartment 13. A nozzle 42 at the end of conduit 38 is for directing a burst of flushing water through the trap 24, which leads to the second siphoning throat 20.

Flushing water may be supplied either through a metered valving arrangement as is common in non-residential installations or by a supply tank as is typical in residential installations.

Figure 2:
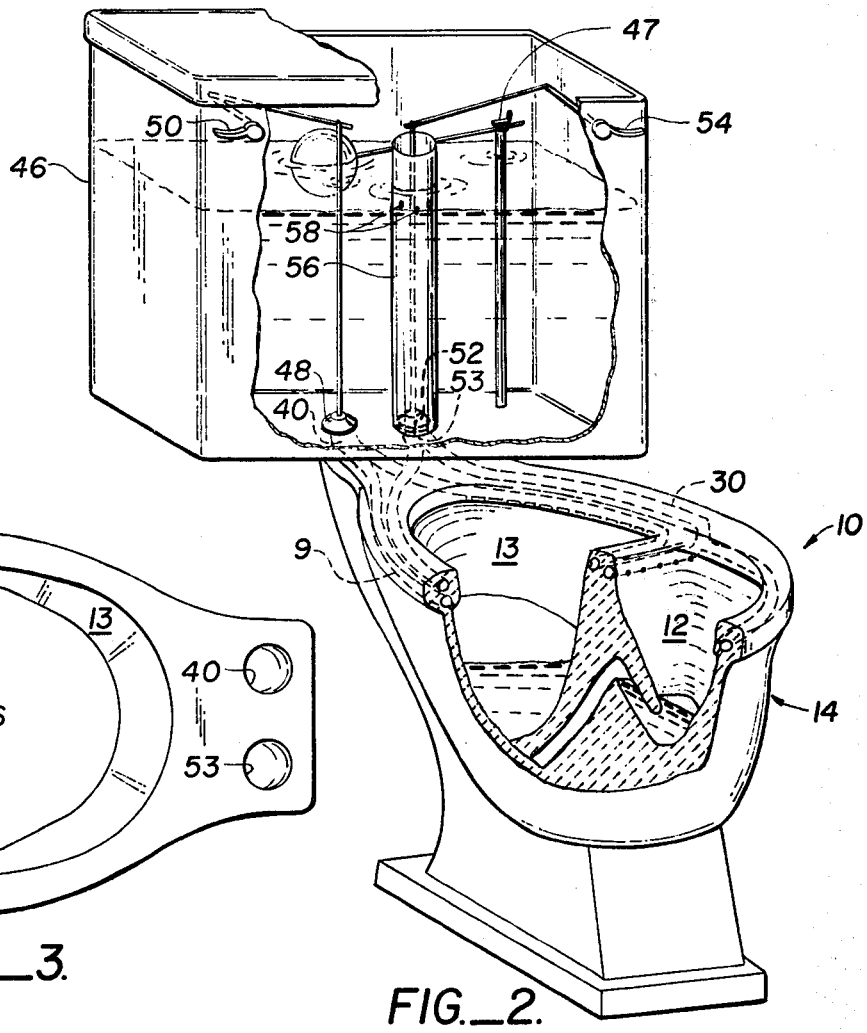
FIG. 2 is an isometric view in partial cutaway showing a tank-type water closet according to the invention.

In FIG. 2, a possible embodiment of a tank-type supply system is illustrated in conjunction with the bowl 14. A tank 46 is provided in which is established an ambient water level by a conventional float valve 47 or the like. A first drain valve plus 48 controls water passage through supply inlet 40 to the aft reservoir 13. Plug 48 is controlled by a first lever and handle 50 in a conventional manner.

Similarly, a second drain valve plug 52 is controlled by a second handle and lever 54 in a conventional manner for providing flush water from a reservoir through a second supply inlet 53 to conduit 30 leading to the forward reservoir 12.

Within the supply tank 46 is a secondary supply reservoir 56. The secondary reservoir 56 may be a hollow tube which is sealed to the base of the tank 46 about the valve plug 52, thereby establishing an isolated water column directly over the valve plug 52 when the supply reservoir 56 is filled. At or near the top of the secondary reservoir 56 there may be provided at least one opening 58 to permit overflow from the ambient level of water in tank 46 to fill the secondary reservoir 56. Since the ambient water level is normally above the openings 58, the filling mechanism for tank 46 also operates to fill the secondary reservoir 56 after evacuation thereof. This eliminates any need for a separate filling mechanism for the secondary reservoir 56. In addition, the level of the opening 58 relative to the ambient level of supply water in tank 46 controls the amount of flush water utilized in the first reservoir flushing operation, since the supply water in tank 46 drains to the level of the openings 58 upon opening of valve plug 52, thereby activating the conventional float valve (not shown).

Figure 3:
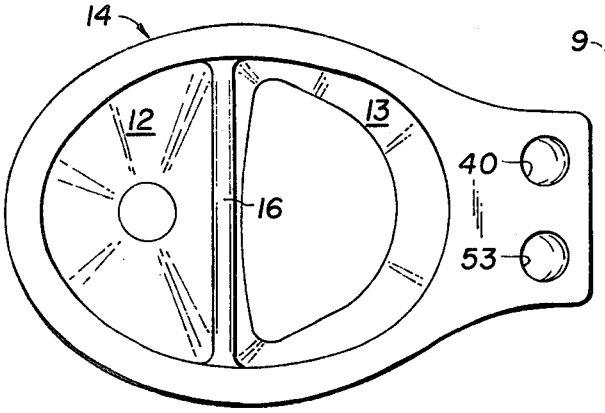
FIG. 3 is a top plan view of the toilet bowl.

Referring now to FIG. 3, the relative location of the forward reservoir 12 and aft reservoir 13 of the toilet bowl 14 is illustrated. The partition or recessed rim 16, which is transverse of the toilet bowl 14, may be located either forwardly or aftwardly, as design considerations may dictate. Furthermore, rim flush may be provided along the outer rim of the toilet bowl 14 above the rim 16 to assure that the top of the partition is adequately cleansed. As is illustrated in FIG. 3, the area or volume of standing water in the forward compartment 12 may be considerably less than in the rear compartment 13. Furthermore, the overall size of the water closet is reduced relative to the size of a conventional water closet, which should also reduce the demands for expulsion of flushing water.

While the invention has been described with reference to specific embodiments, it should be understood that the invention is not to be limited except as indicated by the appended claims.

I claim:

1. A siphoning water closet comprising: a toilet bowl having a pair of opposed sides and an inner, substantially straight partition spanning the distance between and coupled to the sides at least adjacent to the widest part of the bowl to define a first reservoir for receiving liquid wastes and a second reservoir for receiving solid wastes;

first means coupled with said first reservoir and including a first trap for placing said first reservoir in fluid communication with a sewer line;

second means coupled with said second reservoir and including a second trap for placing said second reservoir in fluid communication with said sewer line;

third means coupled with said first reservoir for flushing wastes therefrom; and fourth means coupled with said second reservoir for flushing wastes therefrom independently of the flushing of wastes from said first reservoir, said fourth means including a supply tank having a bottom, said third means including means in the tank and communicating therewith for forming a column of water extending upwardly from said bottom, the water in said column being used to flush the wastes from said first reservoir, wherein said third and fourth means include separate supplies of flush water for said first and second reservoirs, respectively.

2. A water closet according to claim 1 wherein said supply tank has first and second outlet valves in the bottom thereof, there being a valve for each reservoir, respectively, said third means including a supply tube extending upwardly from the bottom of said supply tank in surrounding relationship to the valve corresponding to said first reservoir, so as to provide a separate supply of flush water for said first reservoir, said supply tube having at least one opening in its walls a preselected distance below the ambient level of water in said supply tank for refilling said tube with water from said supply tank after flush water previously contained in said tube has been supplied to said first reservoir.

3. A water closet according to claim 1 wherein said third means and fourth means include first and second flushing rims circumscribing said aft and fore reservoirs.

4. Apparatus for storing and dispensing flush water for a water closet having a pair of flushing conduits comprising:

a water supply tank having a bottom provided with a pair of valves therein, there being a valve for each flushing conduit, respectively, of said water closet;

an elongated hollow member in said tank for receiving and storing a column of flush water to be dispensed through one of said conduits, said member extending upwardly from said bottom to above the ambient water level in said tank and having a lower end surrounding one of the valves, said member having at least one inlet opening below the upper end of the member for filling said member with water from said tank to present a column of water extending from the lower end of the member to said ambient water level, said member being refillable after the column of water previously contained in said member has been dispensed through said one conduit;

first means coupled with said one of the valves for opening the same to permit the column of water in the member to be dispensed through said one conduit; and second means independently of the first means for opening the second valve.

* * * * *